US008444428B2

(12) United States Patent
Chen

(10) Patent No.: US 8,444,428 B2
(45) Date of Patent: May 21, 2013

(54) CARD-EDGE CONNECTOR HAVING A CARD-LATCHING MEMBER WITH A FASTENER MOVABLE ALONG A PASSAGE IN AN ARM OF A HOUSING

(75) Inventor: Chin Yu Chen, Taipei (TW)

(73) Assignee: Tyco Electronics Holding (Bermuda) No. 7 Limited, Pembroke (BM)

( * ) Notice: Subject to any disclaimer, the term of this patent is extended or adjusted under 35 U.S.C. 154(b) by 0 days.

(21) Appl. No.: 13/302,269

(22) Filed: Nov. 22, 2011

(65) Prior Publication Data

US 2012/0129377 A1 May 24, 2012

(30) Foreign Application Priority Data

Nov. 22, 2010 (TW) ..... 99222630 U

(51) Int. Cl.
*H01R 13/62* (2006.01)

(52) U.S. Cl.
USPC ..... 439/327

(58) Field of Classification Search
USPC ..... 439/325–331, 159, 495
See application file for complete search history.

(56) References Cited

U.S. PATENT DOCUMENTS

| | | | | |
|---|---|---|---|---|
| 4,914,552 | A * | 4/1990 | Kecmer | 361/801 |
| 6,319,052 | B1 * | 11/2001 | Chang | 439/495 |
| 7,033,190 | B1 * | 4/2006 | Chen | 439/159 |
| 7,267,565 | B2 * | 9/2007 | Hsu et al. | 439/159 |
| 7,540,742 | B2 | 6/2009 | Hardell | |
| 7,866,998 | B2 * | 1/2011 | Chen | 439/159 |
| 7,927,114 | B2 * | 4/2011 | Li et al. | 439/108 |
| 2005/0101173 | A1 * | 5/2005 | Harasawa | 439/327 |
| 2005/0101174 | A1 * | 5/2005 | Harasawa | 439/327 |
| 2010/0248517 | A1 * | 9/2010 | Li et al. | 439/327 |

* cited by examiner

*Primary Examiner* — Chandrika Prasad
(74) *Attorney, Agent, or Firm* — Barley Snyder

(57) ABSTRACT

A card-edge connector is provided for securing and electrically connecting an electronic card to a circuit board. The card-edge connector includes an insulating housing a pair of arms, and a pair of card-latching members. The insulating housing includes a receiving wall defining a slot there within. Each arm extends from ends of the receiving wall. A supporting base is disposed on and extending along a first side of each arm, and a guiding rail disposed on a second side of each arm. Furthermore, a fastener receiving passageway is disposed on each of an upper surface and a lower surface of each of the pair of arms.

8 Claims, 6 Drawing Sheets

CARD-EDGE CONNECTOR HAVING A CARD-LATCHING MEMBER WITH A FASTENER MOVABLE ALONG A PASSAGE IN AN ARM OF A HOUSING

CROSS-REFERENCE TO RELATED APPLICATION

This application claims the benefit under 35 U.S.C. §119 (a)-(d) of TW Utility Model Application No. 99222630 filed on Nov. 22, 2010.

FIELD OF THE INVENTION

The invention relates to a card-edge connector and, more particularly, to a card-edge connector having a pair of card latching members that can improve the spatial arrangement of electronic devices and enable electronic cards to be retractably inserted therein.

BACKGROUND

Generally, a main circuit board of a typical electronic device is provided with different card-edge connectors to provide slot connection for various modular electronic cards, such that electrical contacts on front edges of the cards can electrically contact with corresponding conductive terminals on the card-edge connectors to achieve electrical connection between the electronic cards and the main circuit board.

A known slot connection between an electronic card and a card-edge connector requires an allotment of space on the front side of the card-edge connector to receive the electronic card. Moreover, a card-edge connector is arranged generally along a lateral side of the electronic device, thus the available space for the insertion of the electronic card is limited and the spatial arrangement of the electronic device is inefficient. Therefore, a need exists in the art to deal with the limited spatial arrangement caused by the conventional horizontal insertion of an electronic card to a card-edge connector.

SUMMARY

An object of the present invention, inter alia, is to provide a card-edge connector for insertion of an electronic card therein in a two-step manner and/or a retractable manner The card-edge connector includes an insulating housing a pair of arms, and a pair of card-latching members. The insulating housing includes a receiving wall defining a slot there within. Each arm extends from ends of the receiving wall. A supporting base is disposed on and extending along a first side of each arm, and a guiding rail disposed on a second side of each arm. Furthermore, a fastener receiving passageway is disposed on each of an upper surface and a lower surface of each of the pair of arms. The pair of card-latching members positioned in the arms, each of the pair of card-latching members having a main body with (a) a guiding block disposed on a first side of the main body, (b) a urging member disposed behind the guiding block, and (c) a fastener disposed on each of an upper side and a lower side of a front end of the main body. The guiding block is movable along the guiding rail and the fastener movable along a corresponding fastener receiving passageway.

BRIEF DESCRIPTION OF THE DRAWINGS

The above and other features of the present invention will become more apparent by describing in detail embodiments thereof with reference to the accompanying drawings, in which.

DETAILED DESCRIPTION OF THE EMBODIMENT(S)

Figure 1:
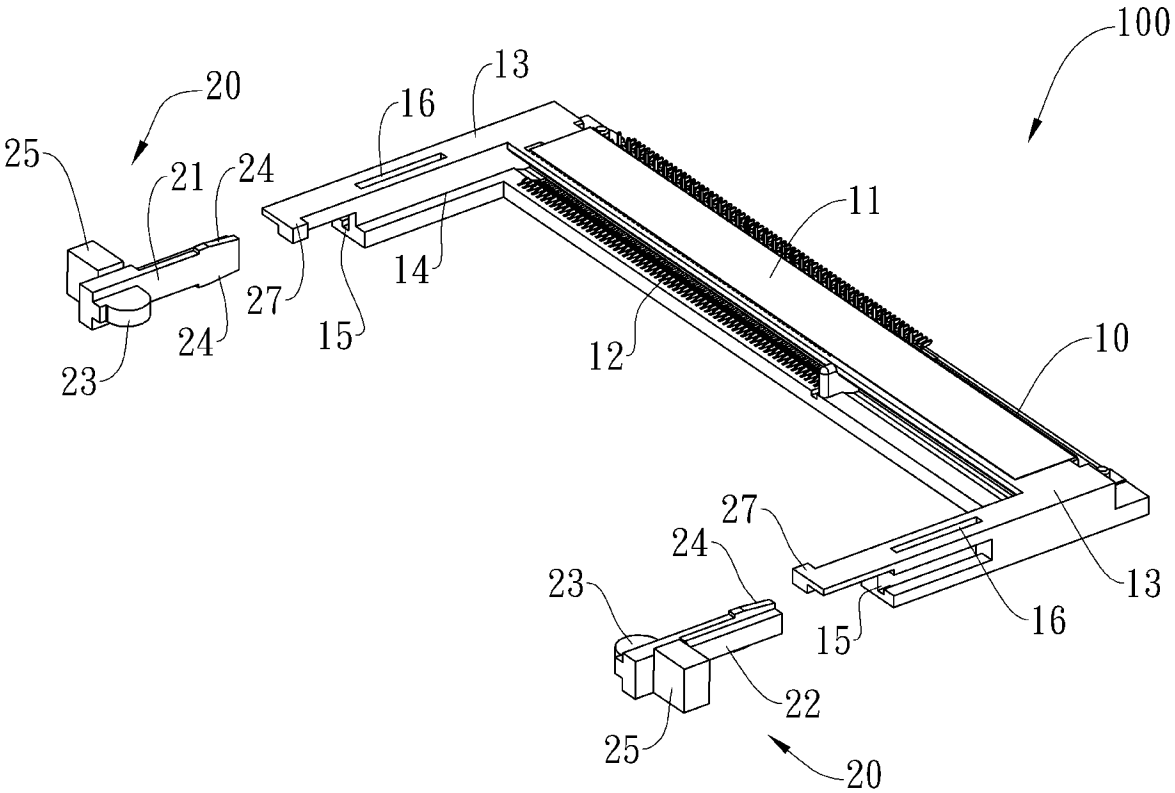
FIG. 1 is an exploded perspective view of a card-edge connector according to the invention.

Referring to the drawings, the invention provides a card-edge connector 100 for securing and electrically connecting an electronic card 1 to a circuit board 2. The card-edge connector 100 according to the invention includes an insulating housing 10, a pair of arms 13, and a pair of card-latching members 20. The insulating housing 10 includes a receiving wall 11 defining a slot 12 there within. Each arm 13 extends from the ends of the receiving wall 11. One side of the arm 13 has a supporting base 14 extending along the arm 13 from the slot 12 and a resisting portion 27 extending from the front end of the arm 13 in a direction toward the slot 12. The other side of the arm 13 is provided with a guiding rail 15. Each of an upper surface and a lower surface of the arm 13 is provided with a fastener receiving passageway 16. The pair of card-latching members 20 are arranged respectively in the arms 13 of the insulating housing 10. Each of the pair of card-latching members 20 includes a main body 21, one side of the main body 21 being provided with a guiding block 22 movable along the guiding rail 15, while the other side of the main body 21 is provided with a clasp member 23. Each of an upper side and a lower side of the front end of the main body 21 is provided with a fastener 24 arranged within and movable along a corresponding fastener receiving passageway 16.

As shown in FIG. 1, one side of the main body 21 is further provided with a urging member 25 arranged behind the guiding block 22 so that the user can push the pair of card-latching members 20 with a finger.

In the embodiment shown, the fastener receiving passageways 16 are elongated openings and the fastener 24 is tapered. Each fastener 24 engages with the fastener receiving passageway 16 to enable the assembly of the pair of card-latching members 20 and the arms 13 of the insulating housing 10. Moreover, the fasteners 24 can move along the fastener receiving passageways 16.

Figure 2:
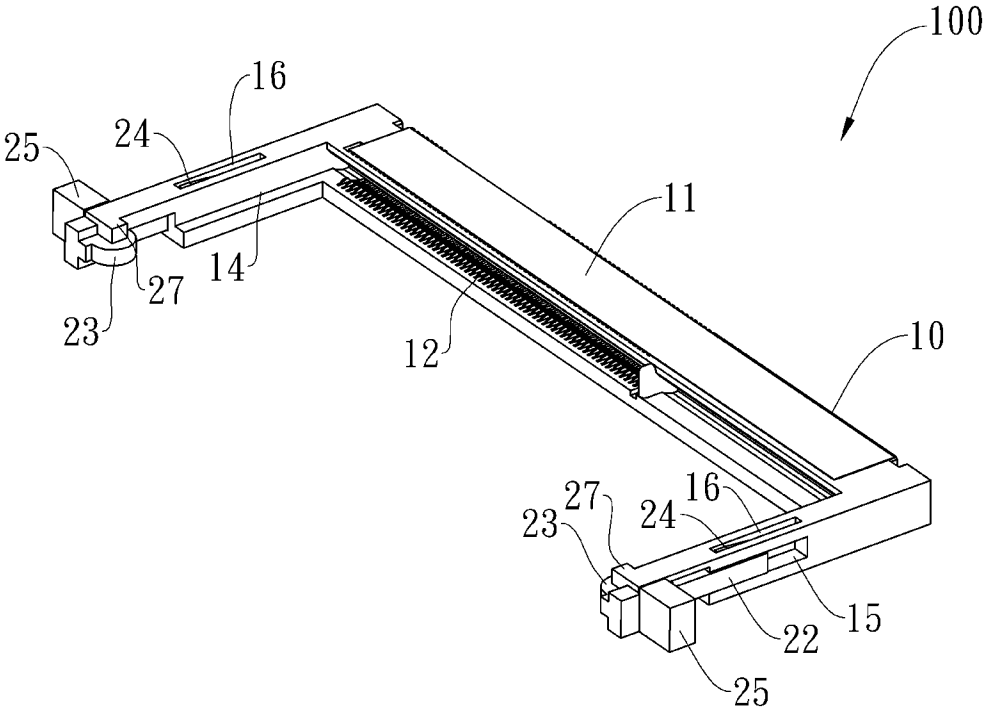
FIG. 2 is a perspective view showing the assembled card-edge connector according to the invention.

Referring to FIG. 1 and FIG. 2, to assemble the card-edge connector 100 of the invention, the pair of card-latching members 20 are placed respectively in the arms 13 at two sides of the insulating housing 10 with the guiding blocks 22 thereof arranged within the guiding rails 15 of the arms 13. Next, the guiding blocks 22 are moved forward along the guiding rails 15 until the fasteners 24 engage with the fastener receiving passageways 16. Next, the urging members 25 are pushed by a user's finger to enable the pair of card-latching members 20 to move freely in the arms 13, thereby to complete the assembly of the card-edge connector 100 of the present invention.

Figure 3A:
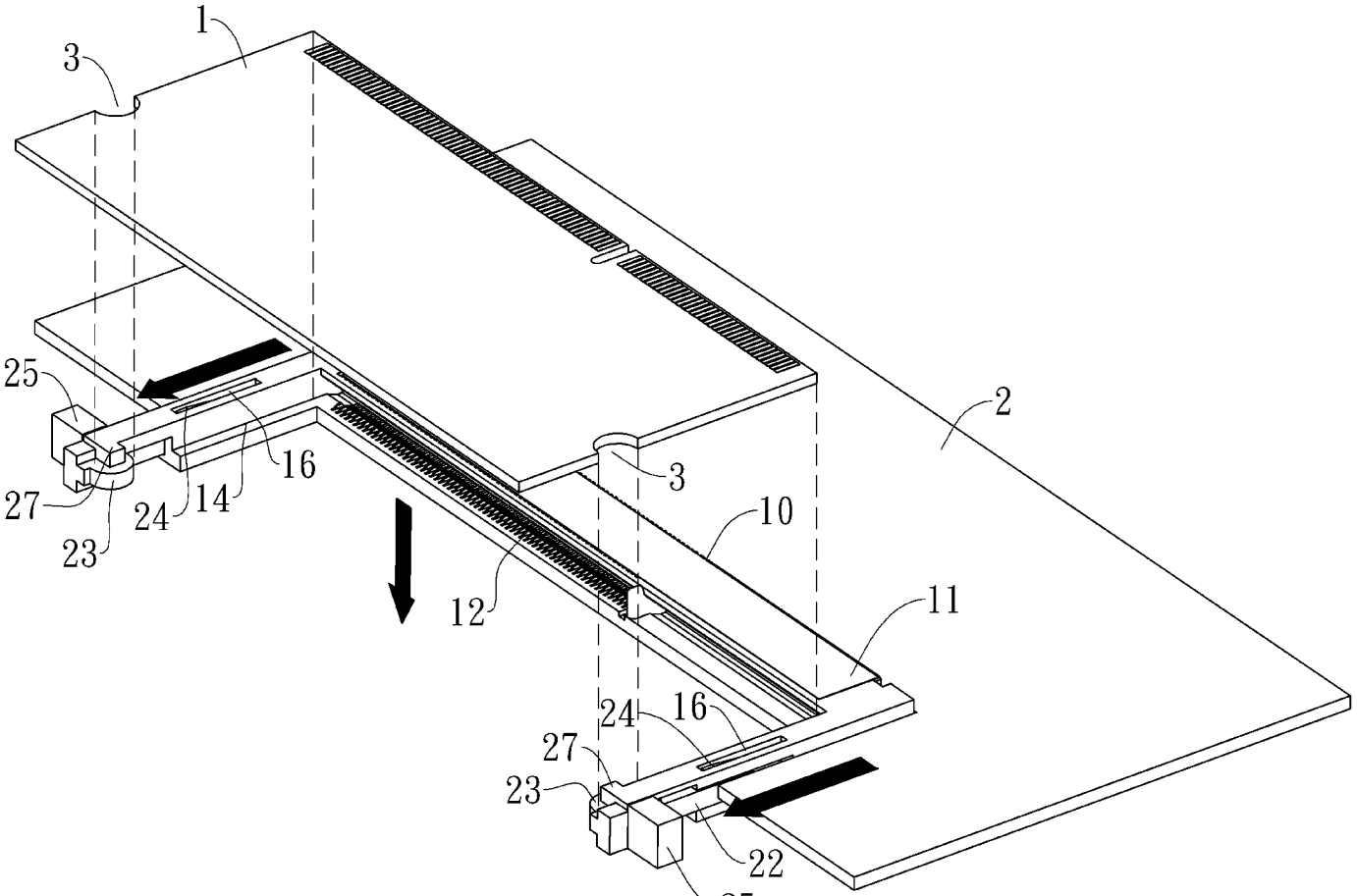
FIG. 3A is an exploded perspective view showing the card-edge connector according to the invention and an electronic card to be inserted therein.
Figure 3B:
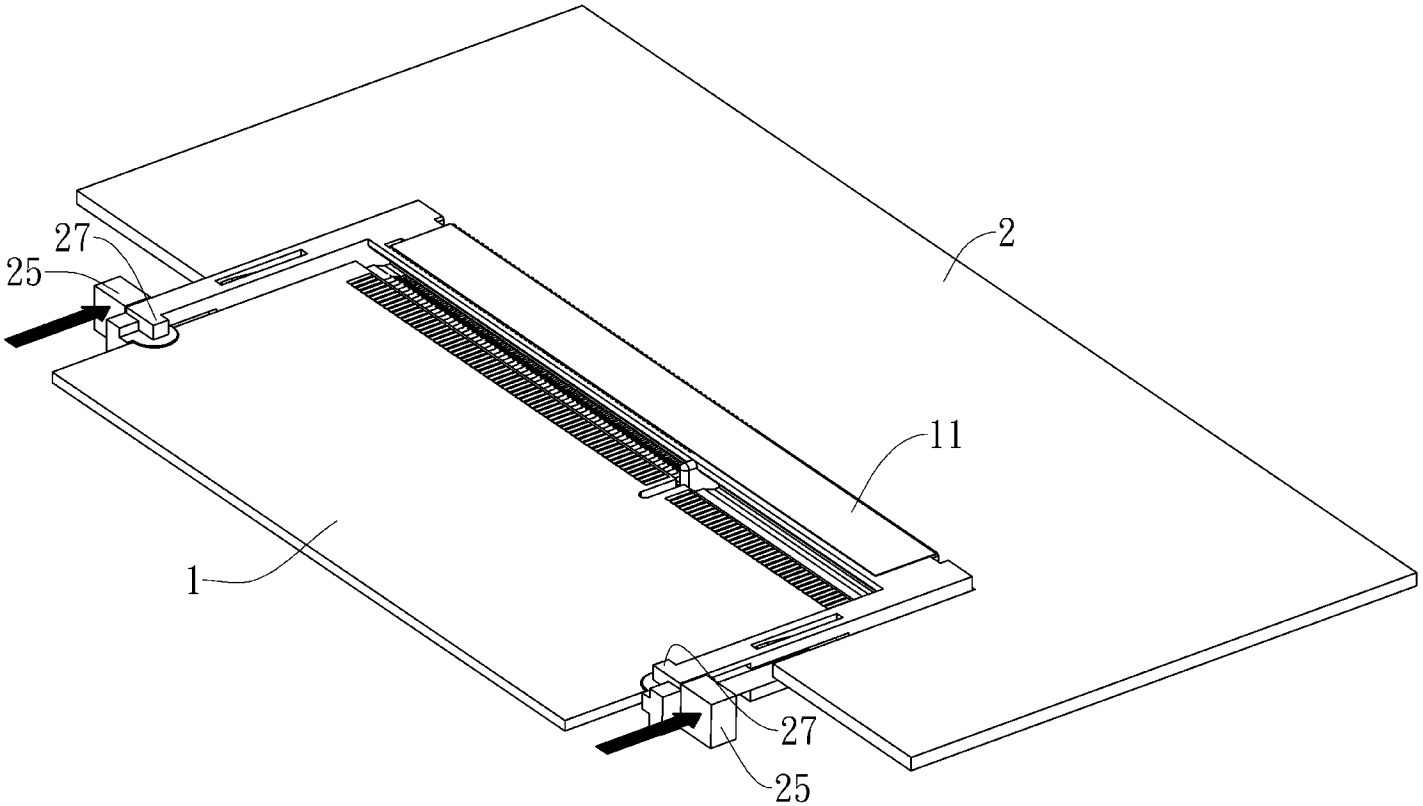
FIG. 3B is another perspective view showing the electronic card and the card-edge connector according to the invention.
Figure 3C:
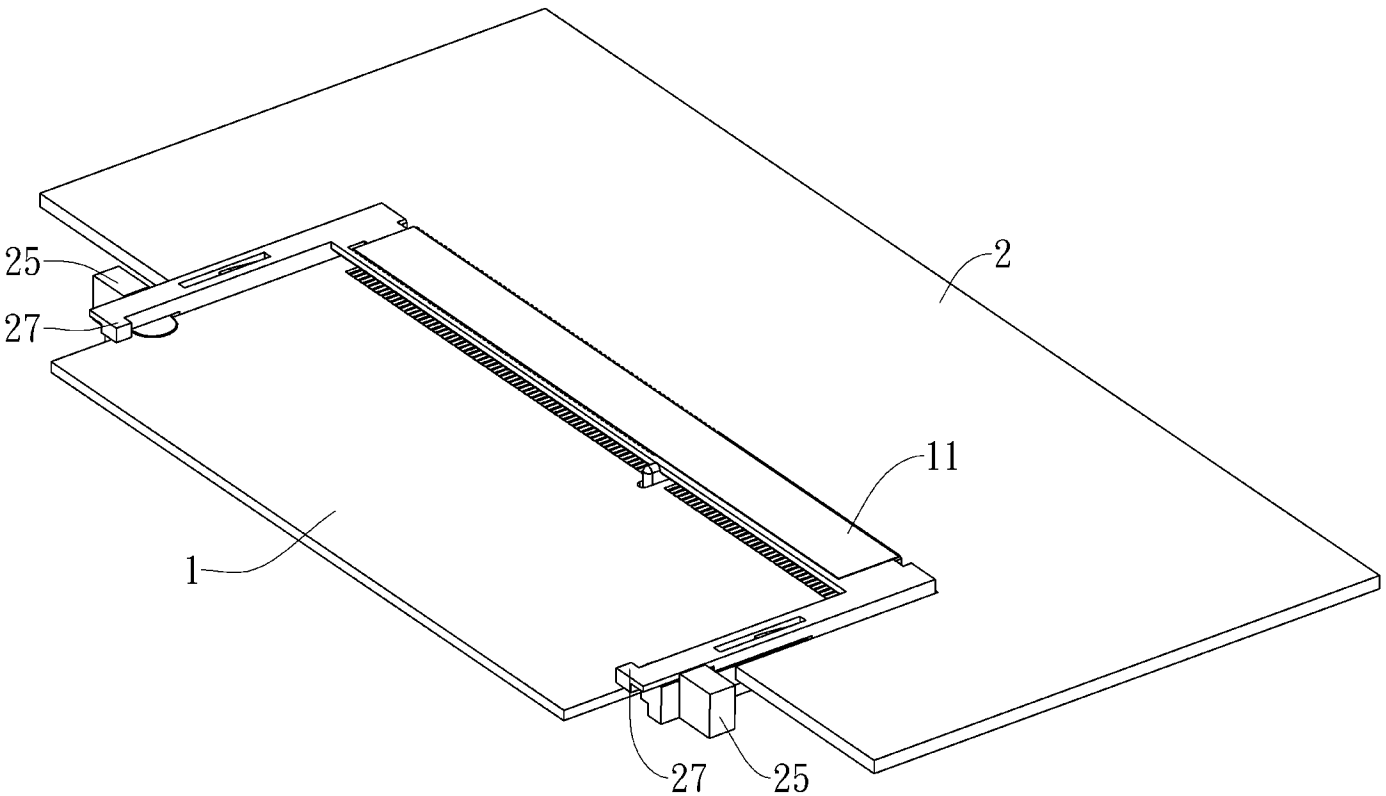
FIG. 3C is a perspective view showing the electronic card connected to the card-edge connector according to the invention.

Referring to FIGS. 3A-3C, which show the insertion of an electronic card 1 to a card-edge connector 100 according to the invention, each of the two edges of the electronic card 1 include a recess 3. To insert the electronic card 1 into the card-edge connector 100 of the invention, the electronic card 1 is initially placed on the supporting bases 14 with its recesses 3 aligned with the clasp members 23 of the pair of card-latching members 20 (see FIG. 3B). The clasp members 23 are configured to engage with the recesses 3 so as to secure the electronic card 1. Next, the urging members 25 are urged to move the guiding blocks 22 along the guiding rails 15 and cause the fasteners 24 to move along the fastener receiving passageways 16 until the electronic card 1 is horizontally inserted to the slot 12 of the receiving wall 11, thereby fixing and/or holding the electronic card 1 (see FIG. 3C). Moreover, the resisting portions 27 are configured to abut against the electronic card 1 to prevent it from turning upward during the process of insertion and upon its complete insertion to the slot 12.

Figure 4A:
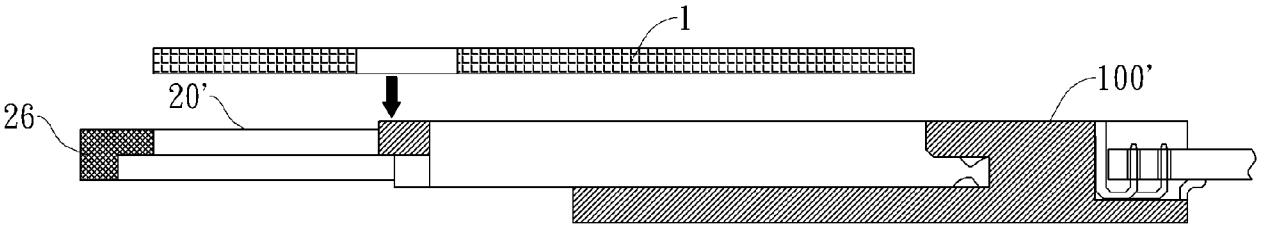
FIGS. 4A-4D are sectional views showing the insertion of an electronic card into a card-edge connector according to the invention.
Figure 4B:
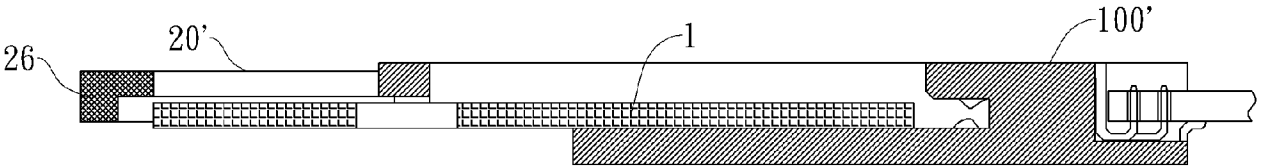
Figure 4C:
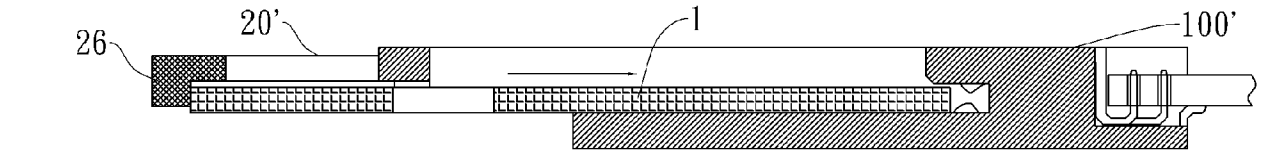
Figure 4D:
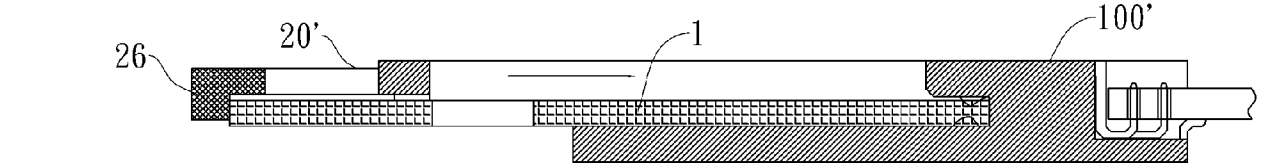

FIGS. 4A-4D are sectional views showing the insertion of an electronic card 1 to a card-edge connector 100' in accordance with another embodiment of the invention. The card-edge connector 100' is generally similar to that of the embodiment shown in FIG. 1, except that the rear end of the main body 21' of each of the pair of card-latching members 20' is provided with a supporting member 26 for propping against two adjacent sides of the electronic card 1, as shown in FIG. 4C, and that no clasp members 23 are required. When the electronic card 1 is placed on the supporting base 14' in a vertical direction (see FIG. 4A), the urging member 25' is pushed (see FIG. 4B) to move the guiding block 22' along the guiding rail 15' until the supporting member 26 props against two adjacent sides of the electronic card 1 (see FIG. 4C). Next, the urging member 25' is continuously pushed to cause the fastener 24' to move along the fastener receiving passageway 16' until the electronic card 1 is horizontally inserted to the slot 12' of the receiving wall 11', thereby fixing and/or holding the electronic card 1 (see FIG. 4D).

In the card-edge connector according to the invention, the provision of a pair of card-latching members retractably movable in the arms of the insulating housing enables the electronic card to be initially placed on the pair of card-latching members. Next, the electronic card is horizontally inserted to the slot of the card-edge connector by means of the structures that enable the pair of card-latching members to be retractable in the arms. With the aforementioned arrangement, the space above the card to be inserted can be exploited effectively and the limited spatial arrangement caused by the insertion of an electronic card to a conventional card-edge connector in a restricted horizontal direction can be improved.

Although several embodiments have been shown and described, it would be appreciated by those skilled in the art that various changes or modifications may be made in these embodiments without departing from the principles and spirit of the disclosure, the scope of which is defined in the claims and their equivalents. In addition, the reference numbers used in the claims are for the purpose of describing particular embodiments only and are not intended to be limiting of example embodiments of the invention.

What is claimed is:

1. A card-edge connector for fixing and electrically connecting an electronic card to a circuit board, the connector comprising:

an insulating housing having a receiving wall defining a slot there within;

a pair of arms extending from each of end of the receiving wall, each arm having:

(a) a supporting base disposed on and extending along a first side of each of the pair of arms;

(b) a guiding rail disposed on a second side of each arm; and (c) a fastener receiving passageway disposed on each of an upper surface and a lower surface of each arm; and a pair of card-latching members individually positioned in each of the pair of arms, and each of the card-latching members having (a) a guiding block disposed on a first side of the card-latching member and movable along the guiding rail of the one of the arms, (b) a urging member disposed behind the guiding block, and (c) a fastener disposed on each of an upper side and a lower side of a front end of the card-latching member and moveable along the fastener receiving passageway of the each arm.

2. The card-edge connector according to claim 1, wherein each card-latching member includes a clasp member disposed on a second side of the card-latching member and configured to engage with the electronic card to secure the electronic card.

3. The card-edge connector according to claim 1, wherein the first side of each of the arms includes a resisting portion extending from a front end of the arm toward the slot in the insulating housing.

4. The card-edge connector according to claim 1, wherein the fastener receiving passageway is an elongated opening.

5. The card-edge connector according to claim 4, wherein the fastener is a tapered member.

6. The card-edge connector according to claim 5, wherein the tapered member engages the elongated opening and the fastener is moveable along the fastener receiving passageway.

7. The card-edge connector according to claim 1, further comprising a supporting member disposed on a rear end of each card-latching member.

8. The card-edge connector according to claim 1, wherein the electronic card is (a) position able on the supporting base and (b) urge able by the urging member to move the guiding block along the guiding rail and cause the fastener to move along the fastener receiving passageway until the electronic card is inserted to the slot of the receiving wall.

* * * * *